US008725302B2

(12) United States Patent
Niemeyer et al.

(10) Patent No.: US 8,725,302 B2
(45) Date of Patent: May 13, 2014

(54) CONTROL SYSTEMS AND METHODS FOR SUBSEA ACTIVITIES

(75) Inventors: Matt W. Niemeyer, Alvin, TX (US); John Yarnold, Webster, TX (US); Jason Gandolfi, Rosharon, TX (US); Javier Cascudo, Missouri City, TX (US); Larry W. Phillips, Angleton, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/278,472

(22) Filed: Oct. 21, 2011

(65) Prior Publication Data

US 2013/0103208 A1 Apr. 25, 2013

(51) Int. Cl.
*G05D 7/06* (2006.01)

(52) U.S. Cl.
USPC ..... 700/282; 700/275; 700/281; 700/3; 700/82

(58) Field of Classification Search
None
See application file for complete search history.

(56) References Cited

U.S. PATENT DOCUMENTS

| | | | | |
|---|---|---|---|---|
| 4,052,703 | A * | 10/1977 | Collins et al. | 714/2 |
| 4,636,934 | A * | 1/1987 | Schwendemann et al. | 700/3 |
| 4,755,943 | A * | 7/1988 | Barnay | 370/462 |
| 4,880,060 | A | 11/1989 | Schwendemann et al. | |
| 5,732,776 | A * | 3/1998 | Tubel et al. | 166/250.15 |
| 6,293,344 | B1 | 9/2001 | Nixon et al. | |
| 6,420,976 | B1 | 7/2002 | Baggs et al. | |
| 6,768,700 | B2 * | 7/2004 | Veneruso et al. | 367/81 |
| 6,913,083 | B2 * | 7/2005 | Smith | 166/336 |
| 7,000,693 | B2 | 2/2006 | Powell | |
| 7,148,812 | B2 * | 12/2006 | Baggs | 340/853.7 |
| RE41,173 | E * | 3/2010 | Baggs | 340/853.7 |
| 7,845,404 | B2 * | 12/2010 | McStay et al. | 166/250.01 |
| 7,958,938 | B2 * | 6/2011 | Crossley et al. | 166/366 |
| 7,967,066 | B2 * | 6/2011 | McStay et al. | 166/250.01 |
| 2002/0112860 | A1 * | 8/2002 | McDaniel | 166/381 |
| 2004/0251030 | A1 * | 12/2004 | Appleford et al. | 166/357 |
| 2004/0262008 | A1 * | 12/2004 | Deans et al. | 166/339 |
| 2007/0107903 | A1 * | 5/2007 | Baggs | 166/344 |
| 2007/0107907 | A1 | 5/2007 | Smedstad et al. | |
| 2009/0260829 | A1 | 10/2009 | Mathis | |
| 2010/0051286 | A1 | 3/2010 | McStay et al. | |

OTHER PUBLICATIONS

International Search Report and Written Opinion mailed on Mar. 21, 2013 for International Patent Application No. PCT/US2012/058260 filed on Oct. 1, 2012, 9 pages.

* cited by examiner

*Primary Examiner* — Kavita Padmanabhan
*Assistant Examiner* — Christopher E Everett
(74) *Attorney, Agent, or Firm* — Jeffery R. Peterson; Brandon S. Clark

(57) ABSTRACT

A control system is for completion installation, intervention and testing activities at a subsea location. The control system has a first control circuit at a surface location; a subsea test tree located in a blowout preventer at the subsea location, the second control circuit located within a riser extending from the blowout preventer towards the surface location; and a plurality of sensors monitoring characteristics of the subsea location. The second control circuit communicates with the first control circuit and receives the characteristics of the subsea location. The second control circuit also controls electrically powered subsea valves based upon commands from the first control circuit and based upon the characteristics of the subsea location to complete a completion installation, intervention, and/or testing activity.

15 Claims, 4 Drawing Sheets

CONTROL SYSTEMS AND METHODS FOR SUBSEA ACTIVITIES

BACKGROUND

Offshore systems (e.g., in lakes, bays, seas, oceans and/or the like) often include a riser which connects a surface vessel's equipment to a blowout preventer at a subsea wellhead. Offshore systems which are employed for well testing operations may also include a safety shut-in system which automatically prevents fluid communication between the well and the surface vessel in the event of an emergency, such as when conditions in the well deviate from preset limits. The safety shut-in system may include a subsea test tree which is landed inside the blowout preventer on a pipe string. The subsea test tree generally includes a valve portion which has one or more safety valves that can automatically shut-in the well via the safety shut-in system.

During well completion installation, intervention and testing activities, a test tree is lowered into a riser from a surface location and landed in a blowout preventer above the well. Valves on the subsea test tree and completion valves are hydraulically operated in one of two ways. First, the valves can be fully hydraulically operated. A hydraulic power unit located at the surface location uses hydraulic pressure both to send control signals to the test tree and to open and close the valves located on the test tree. Second, the valves can be electro-hydraulically operated. An electrical signal is sent to a control circuit subsea. When the subsea control circuit receives the electrical signal to open or close the valves, hydraulic pressure is provided from the surface hydraulic power unit to open and close the valves in response to such electrical signals.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter. The present disclosure results from research and development of systems for control of completion installation, intervention and testing activities. The present inventors have determined that in systems having hydraulic and electro-hydraulic control, various problems and inefficiencies result. For example, both the fully hydraulic and electro-hydraulic valve control systems require a hydraulic power unit at the surface location, which takes up valuable space. Further, both systems require a large umbilical to house hoses that deliver hydraulic fluid to the sea-floor where the control tree is located. Finally, a hydraulically-actuated valve has an intrinsic time delay between the moment a signal is sent and the moment the valve is actuated. The present disclosure provides a subsea control circuit that replaces previously hydraulically powered devices with electrically powered devices. In one embodiment, the control system for completion installation, intervention and testing activities at a subsea location comprises a first control circuit at a surface location. A subsea test tree is located in a blowout preventer at the subsea location. A second control circuit, which communicates with the first control circuit, is located within a riser extending from the blowout preventer towards the surface location. A plurality of sensors monitor characteristics of the subsea location and the second control circuit receives the characteristics. The second control circuit controls the electrically powered subsea valves based upon commands from the first control circuit and based upon the characteristics of the subsea location to complete a completion installation, intervention, and/or testing activity. In another embodiment, a method for controlling completion installation, intervention and testing activities at a subsea location is disclosed. The method comprises providing electrical power to a subsea test tree located in a blowout preventer at the subsea location; providing electrical power to a subsea control circuit located within a riser extending from the blowout preventer towards the surface location; and operating the subsea control circuit to electrically actuate subsea valves to complete a completion installation, intervention, and/or testing activity.

BRIEF DESCRIPTION OF THE DRAWINGS

Embodiments of electrical control systems for subsea wellbore operations are described with reference to the following figures. The same numbers are used throughout the figures to reference like features and components.

DETAILED DESCRIPTION

In the following description, certain terms have been used for brevity, clearness, and understanding. No unnecessary limitations are to be inferred therefrom beyond the requirement of the prior art because such terms are used for descriptive purposes and are intended to be broadly construed. The different systems and methods described herein may be used alone or in conjunction with other systems and methods. It is to be expected that various equivalents, alternatives, and modifications are possible within the scope of the appended claims.

Figure 1:
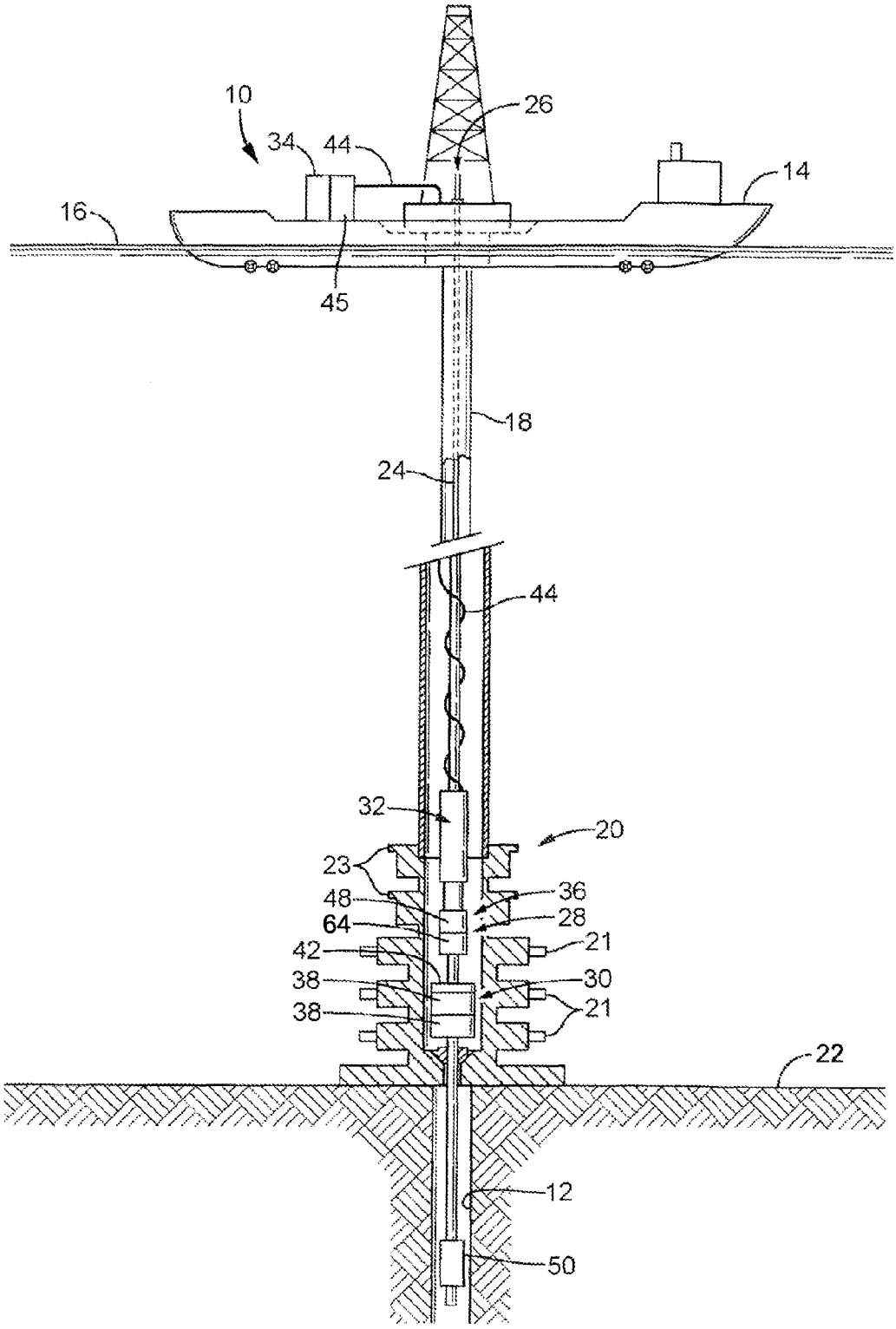
FIG. 1 is a schematic depicting a subsea control system according to an embodiment of the present disclosure.

FIG. 1 illustrates a subsea completion installation, intervention and testing control system 10 which may be employed to test production characteristics of a well 12. The control system 10 may include a surface location such as a vessel 14, which is positioned on a water surface 16, and a riser 18, which connects vessel 14 to a blowout preventer ("BOP") stack 20 on sea floor 22. Although vessel 14 is illustrated as a ship, vessel 14 may include any platform suitable for wellbore testing, intervention or completion installation activities. The well 12 has been drilled into sea floor 22, and a tubing string 24 extends from vessel 14 through BOP stack 20 into well 12. Tubing string 24 is provided with a bore 26 through which hydrocarbons or other formation fluids can be produced from well 12 to the surface during completion installation, intervention and testing of the well 12.

The control system 10 also includes a safety shut-in system 28 which provides automatic shut-in of well 12 when conditions on vessel 14 or in well 12 deviate from preset limits. Safety shut-in system 28 includes a subsea test tree 30 ("SSTT"), an in-riser electrical control module 32, a surface operator station 34, and various subsea safety valves such as retainer valve 36 and safety valves 38.

Subsea test tree 30 is landed in BOP stack 20 on tubing string 24. Subsea test tree 30 has a valve assembly comprising safety valves 38 and a latch 42. Safety valves 38 may act as master control valves during testing of well 12. Latch 42 allows an upper portion of tubing string 24 to be disconnected from subsea test tree 30 if desired. BOP stack 20 may include one or more ram preventers 21 and one or more annular preventers 23. It should be clear that the embodiments are not limited to the particular embodiment of subsea test tree 30 and BOP stack 20 shown, but any other combination of electrically powered valves and preventers that control flow of formation fluids through tubing string 24 may also be used. For instance, a single preventer 21 or 23 could be used rather than a BOP stack 20. Further, safety valves 38 could comprise, for instance, flapper valves and ball valves.

The retainer valve 36 is arranged on tubing string 24 to prevent fluid in an upper portion of the tubing string 24 from draining into riser 18 when disconnected from subsea test tree 30. An umbilical 44 provides a path for conveying the electrical power for operating safety valves 38, latch 42, and retainer valve 36. Umbilical 44 also provides a path for connecting the surface operator station 34 to the in-riser electrical control module 32. The in-riser electrical control module 32 includes a control circuit 64 and other electrical elements such as subsea telemetry boards 56', a power regulator 60, and a battery 62. (See FIG. 3.) These other electrical elements are labeled generally as 48 in FIG. 1.

Subsea test tree 30 is operated such that in the event of an emergency, safety valves 38 can be automatically closed to prevent fluid flow from a lower portion of tubing string 24 to an upper portion of tubing string 24. Once safety valves 38 are closed, the upper portion of tubing string 24 may be disconnected from the subsea test tree 30 and retrieved to vessel 14 to be moved if necessary. Before disconnecting the upper portion of tubing string 24 from subsea test tree 30, retainer valve 36 is closed. Once retainer valve 36 is closed, pressure is trapped within subsea test tree 30, and is subsequently bled off. Next, latch 42 is operated to disconnect the upper portion of tubing string 24 from subsea test tree 30.

It should be noted that in-riser electrical control module 32 can be operated to control more than safety shut-in system 28, including subsea tree 30. In particular, in-riser electrical control module 32 can also be operated to control electrical completion valving 50 located below sea floor 22. Electrical completion valving 50 can include safety valves, flow control valves, and drill string test tools, among other completion valving components.

Figure 2:
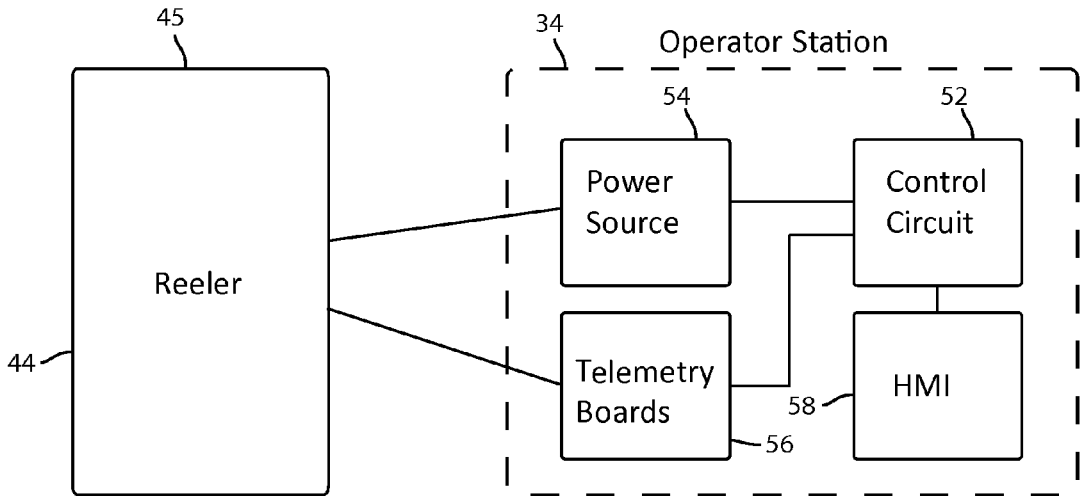
FIG. 2 is a schematic depicting the relationship between elements of the subsea control system that are located at a surface location in an embodiment of the present disclosure.

Turning now to FIG. 2, the portion of subsea completion installation, intervention and testing control system 10 located at the surface location will be described in more detail. Aboard the vessel 14, the control system 10 includes a surface operator station 34 and a reeler 45. The surface operator station 34 includes a first control circuit 52, an electrical power source 54, surface telemetry boards 56, and a human machine interface ("HMI") 58. The first control circuit 52 may include, but is not limited to, a memory, a processor, a transmitter, a receiver, and other electrical components as would be understood by one of skill in the art. The first control circuit 52 may include hardware implementations or software implementations to control the processes described further herein below. An operator can input data and commands to the first control circuit 52 via the HMI 58. The electrical power source 54 provides electrical power to both the first control circuit 52 and, via the umbilical 44, to the second control circuit 64, as described below. The surface telemetry boards 56 communicate with the first control circuit 52 and, via the umbilical 44, with the second control circuit 64, as described herein below. The reeler 45 stores and transports the umbilical 44. The reeler 45 can be powered by electrical power source 54 and controlled by the first control circuit 52 at the surface operator station 34. Although wired connections are shown in FIG. 2, it is possible to provide power to the second control circuit 64 at the sea floor 22 and to communicate with the second control circuit 64 via wireless communication.

Figure 3:
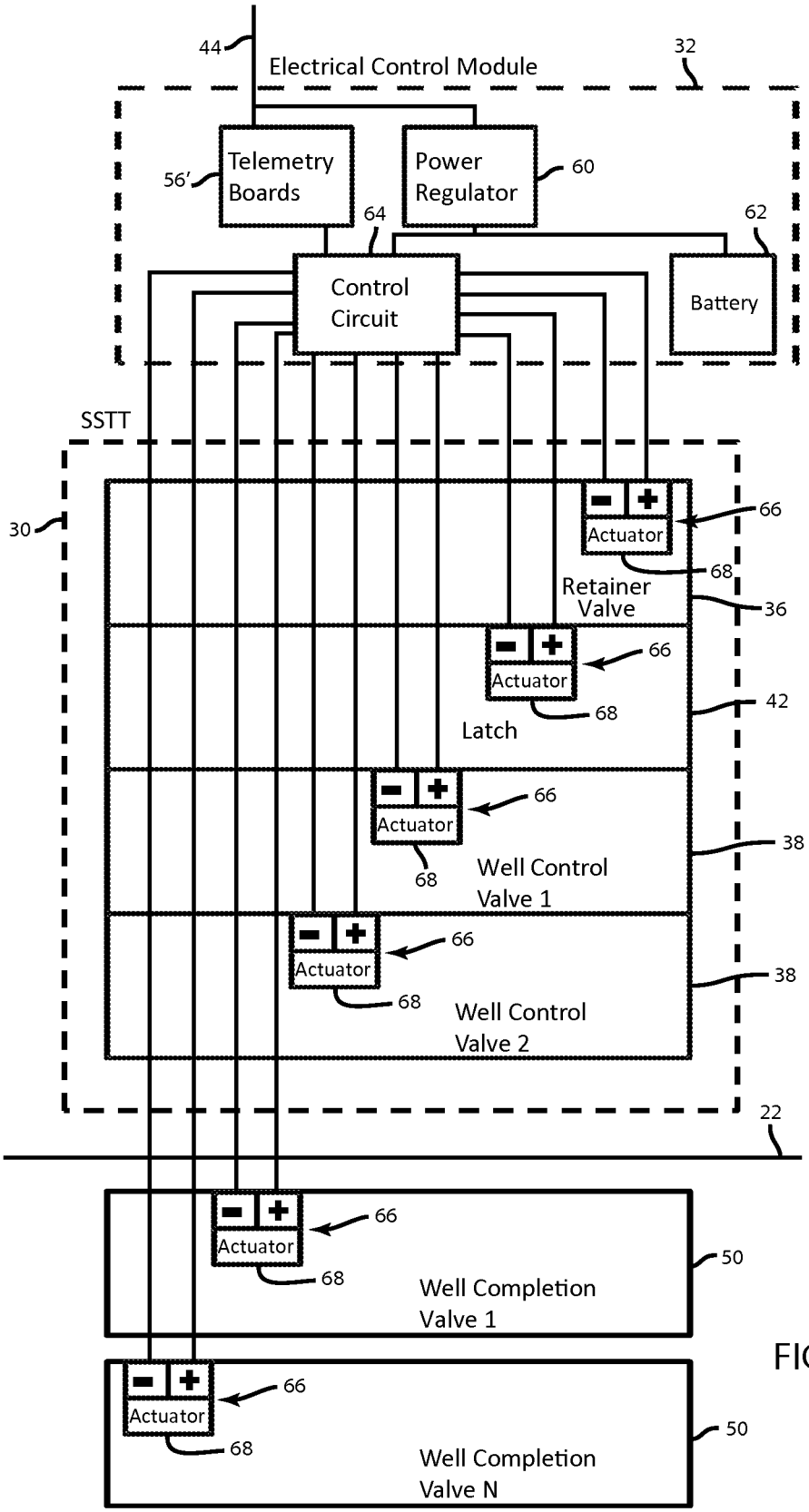
FIG. 3 is a schematic depicting the relationship between elements of the subsea control system that are located at a subsea location according to an embodiment of the present disclosure.

Turning now to FIG. 3, the in-riser electrical control module 32, subsea test tree 30, and electrical completion valving 50 will be described in more detail. As mentioned above, electrical power is provided to the in-riser electrical control module 32 via the umbilical 44. Signals from surface telemetry boards 56 located at the surface operator station 34 are received by subsea telemetry boards 56' housed within the in-riser electrical control module 32. The in-riser electrical control module 32 also houses a power regulator 60, a battery 62, and a second control circuit 64. The second control circuit 64 may include, but is not limited to, a memory, a processor, a transmitter, a receiver, input/output arrangements, other electrical components, and hardware and software implementations as would be understood by one of skill in the art. For instance, the second control circuit 64 may comprise, but is not limited to, a programmable logic controller, a remote terminal unit, or a distributed control system. The second control circuit 64 is connected to a plurality of valve drivers 66, each having an actuator 68 and positive and negative terminals for connection to and communication with the second control circuit 64. The valve drivers 66 operate valves in the subsea test tree 30, such as the retainer valve 36, latch 42, and well control valves such as safety valves 38. Second control circuit 64 is also connected to valve drivers 66, including actuators 68, that control electrical completion valving 50 below the sea floor 22.

Figure 4:
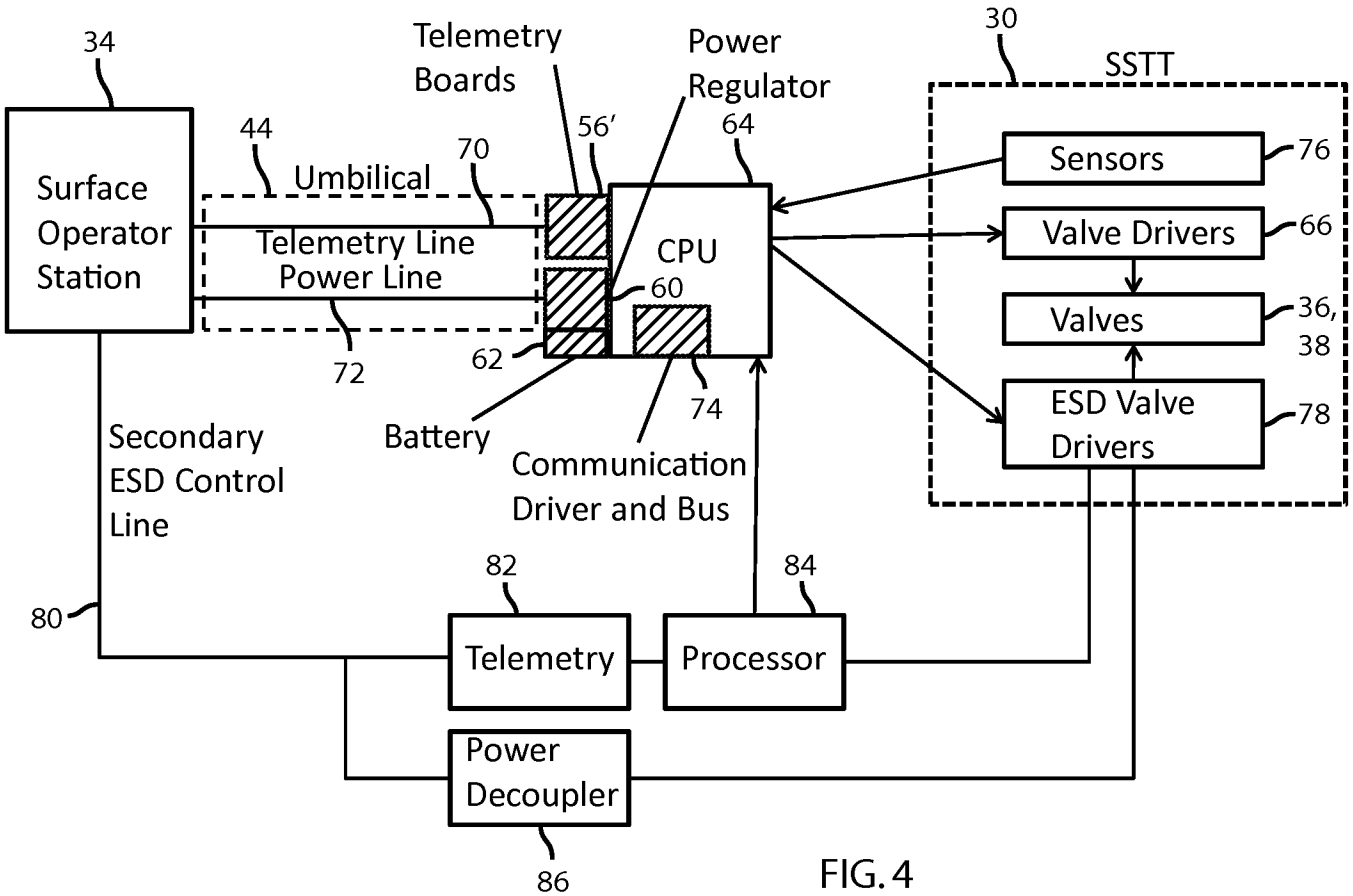
FIG. 4 is a schematic depicting overall relationships and communications within an embodiment of the subsea control system.

Now with reference to FIG. 4, overall relationships and communications within the control system 10 will be described. Control system 10 includes the surface operator station 34 connected via the umbilical 44 to the in-riser electrical control module 32. The umbilical 44 houses both a telemetry line 70 and a power line 72. Of course, if wireless communications and/or non-surface-supplied electrical power are used, these elements could be omitted. The telemetry line 70 connects the surface telemetry boards 56 to the subsea telemetry boards 56' located in the in-riser electrical control module 32. The power line 72 connects the electrical power source 54 to the power regulator 60 located in the in-riser electrical control module 32. The battery 62 is also included in in-riser electrical control module 32. The in-riser electrical control module 32 further includes a second control circuit 64 (shown in FIG. 3), and a communications driver and bus 74. The second control circuit 64 communicates with elements of the subsea test tree 30 including sensors 76, valve drivers 66, subsea valves 36, 38, 42 (shown in FIG. 3) and emergency system disconnect ("ESD") valve drivers 78, which will be described further below. The second control circuit 64 also communicates with electrical completion valving 50, as shown in FIG. 3. The control system 10 also includes a secondary emergency system disconnect control line 80 that bypasses the second control circuit 64 and communicates with the subsea test tree 30. The secondary ESD control line 80 comprises ESD telemetry 82, a processor 84, and a power decoupler 86. The secondary ESD control line 80 controls the ESD valve drivers 78, as will be described further below.

Now with reference to all the FIGS. 1-4, control system 10 for completion installation, intervention and testing activities at a subsea location will be described. The control system 10 comprises a first control circuit 52 at surface location; a subsea test tree 30 located in blowout preventer 21, 23 at the subsea location; and a second control circuit 64 located within a riser 18 extending from the blowout preventer 21, 23 towards the surface location. The second control circuit 64 communicates with the first control circuit 52. A plurality of sensors 76 monitor characteristics of the subsea location, and the second control circuit 64 receives the characteristics. The second control circuit 64 controls electrically powered subsea valves 36, 38, 42 based upon commands from the first control circuit 52 and based upon the characteristics of the subsea location to complete one of a completion installation, intervention and testing activity. The subsea valves 36, 38, 42 are located on the subsea test tree 30 and are actuated by a plurality of electrically powered valve drivers 66. Other subsea valves controlled by the second control circuit 64 include electrical completion valving 50.

The control system 10 further comprises an electrical power source 54 at the surface location and an electrical power line 72 extending from the electrical power source 54 to the subsea test tree 30. Power regulator 60 is connected to the power line 72 to filter and control the power levels required by the in-riser electrical control module 32. The battery 62 is connected to the power regulator 60 to provide for autonomous working of the in-riser electrical control module 32 if power from the surface electrical power source 54 is disconnected. The power regulator 60 also separates critical and non-critical power, allowing the control system 10 to better regulate and control power consumption, allowing the battery 62 to last longer.

Control system 10 further comprises telemetry lines 70 enabling communication between the first control circuit 52 and the second control circuit 64. The telemetry lines 70 are fed to subsea telemetry boards 56', which can include a modem that decodes data and commands sent from the surface and relays them to the second control circuit 64. The modem can also encode data it receives from the second control circuit 64 and relay it back to the surface operator station 34.

The control system 10 controls the electrically powered subsea valves 36, 38, 42 to complete a safety shut-in activity. The safety shut-in activity is performed by safety shut-in system 28 when an emergency is detected in the area, either at the surface or subsea. The safety shut-in activity may also be conducted upon completion installation of the electrical completion valving 50. The safety shut-in activity is carried out as the second control circuit 64 interprets commands sent from the surface operator station 34 and opens or closes subsea valves 36, 38, 42 and electrical completion valving 50 as needed.

The second control circuit 64 collects and processes data from the sensors 76 that monitor the subsea test tree 30 environment. The second control circuit 64 processes commands from the surface operator station 34 and sends commands to the valve drivers 66 to open and close valves as needed. The subsea valves 36, 38, 42 and electrical completion valving 50 are fully electrically powered and can be powered by the battery 62 should power via the power line 72 be cut off. In the event that telemetry communications or power from the surface operator station 34 are cut off, the second control circuit 64 will be able to log data collected from the sensors 76 and transfer this data to the surface once telemetry is reestablished. The second control circuit 64 can also communicate with other sub-processors in other electrical control modules through the communications driver and bus 74. Electrical subsea valves 36, 38, 42 in the subsea test tree 30 and electrical completion valving 50 are powered by valve drivers 66. The valve drivers 66 receive commands from the second control circuit 64 and deliver electric current to the subsea valves 36, 38, 42 and electrical completion valving 50 to activate them to open or close. The valves are opened or closed to conduct one of a completion installation, intervention, testing, and safety shut-in activity. However, activation of the valves is not limited to these activities and could be used for well stimulation or abandonment, for instance.

The control system 10, when compared to prior control systems utilizing hydraulic or electro-hydraulic control of valves, reduces the need for surface area at the surface location, such as vessel 14. Further, the umbilical 44 can be downsized as it houses electrical conductors for power and telemetry rather than hydraulic lines. The control system 10 is more efficient than hydraulic or electro-hydraulic systems, which experience hydraulic pump losses. Leakage of hydraulic driving mechanisms will also be eliminated with a fully electrical system.

The emergency system disconnect ("ESD") function will now be described. Generally, subsea valves 36, 38, 42 on the subsea test tree 30 and electrical completion valving 50 are actuated in response to an emergency system disconnect command sent from the first control circuit 52 to the second control circuit 64, to the plurality of electrically powered ESD valve drivers 78. If certain conditions are met (for example, communications between the first control circuit 52 and the second control circuit 64 are cut off) the system will run a primary ESD pattern. In one embodiment, running the primary ESD pattern comprises closing the subsea valves 36, 38, 42 and electrical completion valving 50 with electrical ESD valve drivers 78. The primary ESD pattern can run even if power from the power line 72 is interrupted, due to inclusion of the battery 62 in the in-riser electrical control module 32. Control system 10 also includes a secondary ESD pattern that comprises sending commands from the first control circuit 52 that bypass the second control circuit 64. The secondary ESD pattern is also fully electrical and conducts an ESD pattern if triggered from the surface. The secondary ESD pattern controls both the valves 36, 38, 42 on the subsea test tree 30 and the electrical completion valving 50. The secondary ESD control line 80 is configured such that running the secondary ESD pattern comprises isolating and regulating power from the electrical power source 54 at the surface location before providing it to the subsea test tree 30. The processor 84 disables communication between the second control circuit 64 and the ESD valve drivers 78, allowing the ESD valve drivers 78 to be controlled by the first control circuit 52 via the secondary ESD control line 80 instead. Because the control system 10 comprises both primary and secondary ESD patterns, the subsea valves 36, 38, 42, 50 are therefore actuated by a plurality of valve drivers, wherein the plurality of valve drivers comprises a set of valve drivers that receive commands from the second control circuit 64 and a set of valve drivers that receive commands from the first control circuit 52 that bypass the second control circuit 64.

The control system 10 can be operated according to a method for controlling completion installation, intervention and testing activities at a subsea location. The method comprises providing electrical power to a subsea test tree 30 located in a blowout preventer 21, 23 at the subsea location, providing electrical power to a subsea control circuit 64 located within a riser 18 extending from the blowout preventer 21, 23 towards the surface location, and operating the subsea control circuit 64 to electrically actuate subsea valves 36, 38, 42, 50 to complete one of a completion installation, intervention and testing activity.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A control system for completion installation, intervention and testing activities at a subsea location, the control system comprising:

a first control circuit at a surface location;

a subsea test tree located in a blowout preventer at the subsea location;

a second control circuit located within a riser extending from the blowout preventer towards the surface location, the second control circuit configured to communicate with the first control circuit; and a plurality of sensors monitoring characteristics of the subsea location, the second control circuit receiving the characteristics;

wherein the second control circuit is configured to electrically actuate fully electrically powered subsea valves based upon commands from the first control circuit and based upon the characteristics of the subsea location to complete one of a completion installation, intervention and testing activity;

wherein the subsea valves are actuatable in response to a first disconnect command from the first control circuit to the second control circuit and wherein the subsea valves are actuated by a plurality of electrically powered disconnect valve drivers; and wherein a second disconnect command bypasses the second control circuit and any other circuit located at a subsea location to actuate a set of valve drivers that actuate the subsea valves.

2. The control system of claim 1, wherein the second control circuit is further configured to electrically actuate the subsea valves to complete a safety shut-in activity.

3. The control system of claim 1, wherein the subsea valves are located on the subsea test tree.

4. The control system of claim 1, further comprising telemetry lines enabling communication between the first control circuit and the second control circuit.

5. The control system of claim 1, further comprising an electrical power source at the surface location and an electrical power line extending from the electrical power source to the subsea test tree.

6. The control system of claim 5, further comprising a power regulator connected to the power line.

7. The control system of claim 6, further comprising a battery connected to the power regulator.

8. A method for controlling completion installation, intervention and testing activities at a subsea location, the method comprising:

providing electrical power to a subsea test tree located in a blowout preventer at the subsea location;

providing electrical power to a subsea control circuit located within a riser extending from the blowout preventer towards a surface location;

operating the subsea control circuit to electrically actuate fully electrically powered subsea valves to complete one of a completion installation, intervention and testing activity, operating a surface control circuit to electrically actuate fully electrically powered subsea valves, bypassing the subsea control circuit and any other subsea circuit; and actuating the subsea valves with a plurality of valve drivers, wherein the plurality of valve drivers comprises a set of valve drivers that receive commands from the subsea control circuit and a set of valve drivers that receive commands from the surface control circuit that bypass the subsea control circuit.

9. The method of claim 8, further comprising operating the surface control circuit at the surface location to communicate with the subsea control circuit.

10. The method of claim 8, further comprising regulating the electrical power before providing it to the subsea test tree.

11. The method of claim 10, further comprising providing the electrical power from a power source at the surface location, and activating a battery if power from the source at the surface location is interrupted.

12. The method of claim 11, further comprising running an emergency system disconnect pattern if a set of conditions are met.

13. The method of claim 12, wherein running the emergency system disconnect pattern comprises closing the subsea valves.

14. The method of claim 12, wherein one of the set of conditions is that communications between the surface control circuit and the subsea control circuit are lost.

15. The method of claim 8, further comprising isolating and regulating power from the source at the surface location before providing it to the subsea test tree.

* * * * *